US012570331B2

(12) United States Patent
Gageik

(10) Patent No.: US 12,570,331 B2
(45) Date of Patent: Mar. 10, 2026

(54) VEHICLE WITH AIR OUTLET OPENING

(71) Applicant: Siemens Mobility GmbH, Munich (DE)

(72) Inventor: Manuel Alexander Gageik, Toenisvorst (DE)

(73) Assignee: Siemens Mobility GmbH, Munich (DE)

( * ) Notice: Subject to any disclaimer, the term of this patent is extended or adjusted under 35 U.S.C. 154(b) by 948 days.

(21) Appl. No.: 17/773,663

(22) PCT Filed: Oct. 19, 2020

(86) PCT No.: PCT/EP2020/079315
§ 371 (c)(1),
(2) Date: May 2, 2022

(87) PCT Pub. No.: WO2021/083698
PCT Pub. Date: May 6, 2021

(65) Prior Publication Data

US 2022/0379931 A1 Dec. 1, 2022

(30) Foreign Application Priority Data

Oct. 31, 2019 (DE) ..... 10 2019 216 838.8

(51) Int. Cl.
*B61C 7/00* (2006.01)
*B61D 27/00* (2006.01)

(52) U.S. Cl.
CPC ..... *B61C 7/00* (2013.01); *B61D 27/0018* (2013.01)

(58) Field of Classification Search
CPC .. B61C 7/00; B61C 17/04; B61C 5/02; B61D 27/00; B61D 27/0018; B61D 27/0072
See application file for complete search history.

(56) References Cited

U.S. PATENT DOCUMENTS

2013/0210333 A1 8/2013 Kober et al.
2022/0379931 A1* 12/2022 Gageik ..... B61C 7/00

FOREIGN PATENT DOCUMENTS

| | | | |
|---|---|---|---|
| CN | 103201126 | A | 7/2013 |
| CN | 204279441 | U | 4/2015 |
| DE | 523925 | C | 5/1931 |
| DE | 1964940 | A1 | 7/1971 |
| DE | 4405377 | A1 | 9/1994 |
| DE | 102009043101 | A1 | 3/2011 |
| DE | 102013217628 | A1 | 3/2015 |
| DE | 102015219157 | A1 | 4/2017 |

(Continued)

*Primary Examiner* — Jason C Smith
(74) *Attorney, Agent, or Firm* — Laurence A. Greenberg; Werner H. Stemer; Ralph E. Locher

(57) ABSTRACT

A vehicle includes at least one air inlet opening for admitting ambient air, at least one air outlet opening for discharging the ambient air, and an air-cooled cooling device connected to the air inlet opening and the air outlet opening for cooling one or more vehicle components. The air outlet opening is equipped with at least one guide device, which is adjustable and is pivoted automatically or in a manner driven by an adjustment device on the air outlet side into a forward travel position when the vehicle is travelling in a direction of forward travel and into a reverse travel position, which differs from the forward travel position, when the vehicle is travelling in a direction of reverse travel.

10 Claims, 7 Drawing Sheets

(56) References Cited

FOREIGN PATENT DOCUMENTS

| | | | | | |
|---|---|---|---|---|---|
| EP | 3184340 | A1 * | 6/2017 | ..... | B60K 11/04 |
| JP | S5765163 | U | 4/1982 | | |
| JP | 11139171 | A * | 5/1999 | ..... | B66F 9/07595 |
| WO | WO-2014046863 | A1 * | 3/2014 | ..... | B60K 11/04 |
| WO | WO-2019170602 | A1 * | 9/2019 | ..... | B61C 17/00 |

* cited by examiner

VEHICLE WITH AIR OUTLET OPENING

FIELD AND BACKGROUND OF THE INVENTION

The invention relates to a vehicle with at least one air inlet opening for admitting ambient air, at least one air outlet opening for discharging the ambient air and an air-cooled cooling device connected to the air inlet opening and the air outlet opening for cooling one or more vehicle components.

Such a vehicle is known from unexamined German application DE 10 2013 217 628 A1, for instance. With the afore-said vehicle, fixedly attached deflection grids are available in the region of the air outlet opening.

SUMMARY OF THE INVENTION

The object underlying the invention is to specify a vehicle with an air outlet opening, in which the blowing-out of ambient air is optimized.

This object is achieved according to the invention by a vehicle having the features described below. Advantageous embodiments of the vehicle according to the invention are disclosed in dependent claims.

Provision is then made in accordance with the invention for the air outlet opening to be equipped with at least one guide device, which can be adjusted and is pivoted automatically or in a manner driven by an adjustment device on the air outlet side into a forward travel position when the vehicle is traveling in a direction of forward travel and into a reverse travel position, which differs from the forward travel position, when the vehicle is traveling in a direction of reverse travel.

One significant advantage of the inventive vehicle consists in guide devices being adjustable in the region of the air outlet opening and thus being able to be set as a function of the direction of travel such that they can achieve a guide effect which is adjusted to the respective direction of travel.

It is advantageous if the guide device or at least one of the guide devices is oriented such that with a vehicle journey, the ambient air blown out through the air outlet opening is blown out as a function of the direction of travel in each case against or at least predominantly against the respective direction of travel. By blowing out against the direction of travel, a thrust force in the direction of travel and thus a reduction in the energy consumption of the vehicle drive can advantageously be achieved. If the cooling device is equipped with a fan for drawing in and blowing out ambient air, the blow-out direction against the respective direction of travel reduces the required fan power because the blown-out air is carried along by the headwind; in other words less powerful fans can advantageously be used than in the case of a different blow-out direction.

The guide device or at least one of the guide devices preferably has two surfaces, of which one is the windward surface facing the headwind both with forward travel and also reverse travel and the other is the leeward surface facing away from the headwind both with forward travel and also reverse travel.

With an embodiment variant considered to be particularly advantageous, provision is made for the or at least one of the guide devices of the air outlet opening to be pivotable and

- with forward travel in a forward travel pivoting position, in which the ambient air blown out through the air outlet opening is blown out in the direction of reverse travel or at least predominantly in the direction of reverse travel, to be pivoted and

- with reverse travel in a reverse travel pivoting position to be pivoted, in which the ambient air blown out through the air outlet opening is blown out in the forward travel direction or at least predominantly in the forward travel direction.

It is also advantageous if the cooling device comprises a fan, which draws in the ambient air from the air inlet opening and blows the same out at the air outlet opening, namely in each case with a higher flow speed than the travel speed of the vehicle by generating a thrust force driving the vehicle.

The cooling device preferably comprises a heat exchanger, which cools a coolant available for cooling vehicle-side operating components with the air flowing via the air inlet opening.

The air outlet opening is preferably arranged on the vehicle floor. The ambient air blown out through the air outlet opening when the vehicle is traveling is preferably blown out against the respective direction of travel or at least predominantly against the respective direction of travel, in other words preferably parallel to the vehicle floor or substantially parallel thereto (preferably with a phase-angle error of at most ±10° relative to the horizontal or to the vehicle floor or to the route traveled) into the gap between the track-side floor and the vehicle floor.

Alternatively, the air outlet opening can be arranged in the ceiling area.

The air inlet opening is preferably equipped with one or more guide devices, which can be adjusted as a function of the direction of travel and are aligned automatically or in a manner driven by an adjustment device on the air inlet side as a function of the direction of travel.

The or at least one of the guide devices on the air inlet side is preferably pivoted, namely

- with forward travel in a forward travel pivoting position, in which a first surface of the guide device on the air inlet side is the windward surface and a second surface of the guide device on the air inlet side is the leeward surface, and
- with reverse travel in a reverse travel pivoting position, in which the first surface is again the windward surface and the second surface is again the leeward surface.

The vehicle is preferably a rail vehicle.

The air outlet opening is preferably arranged on the rail vehicle floor. The ambient air blown out through the air outlet opening during vehicle travel is preferably blown out against the respective direction of travel into the gap between the track bed and the vehicle floor.

The invention is explained in more detail below with reference to exemplary embodiments.

BRIEF DESCRIPTION OF THE FIGURES

FIG. 3 shows an exemplary embodiment of suitable guide devices for the vehicle according to FIGS. 1 and 2, wherein FIG. 3 shows both the forward travel position and also the reverse travel position of the guide devices.

DETAILED DESCRIPTION OF THE INVENTION

Figure 1:
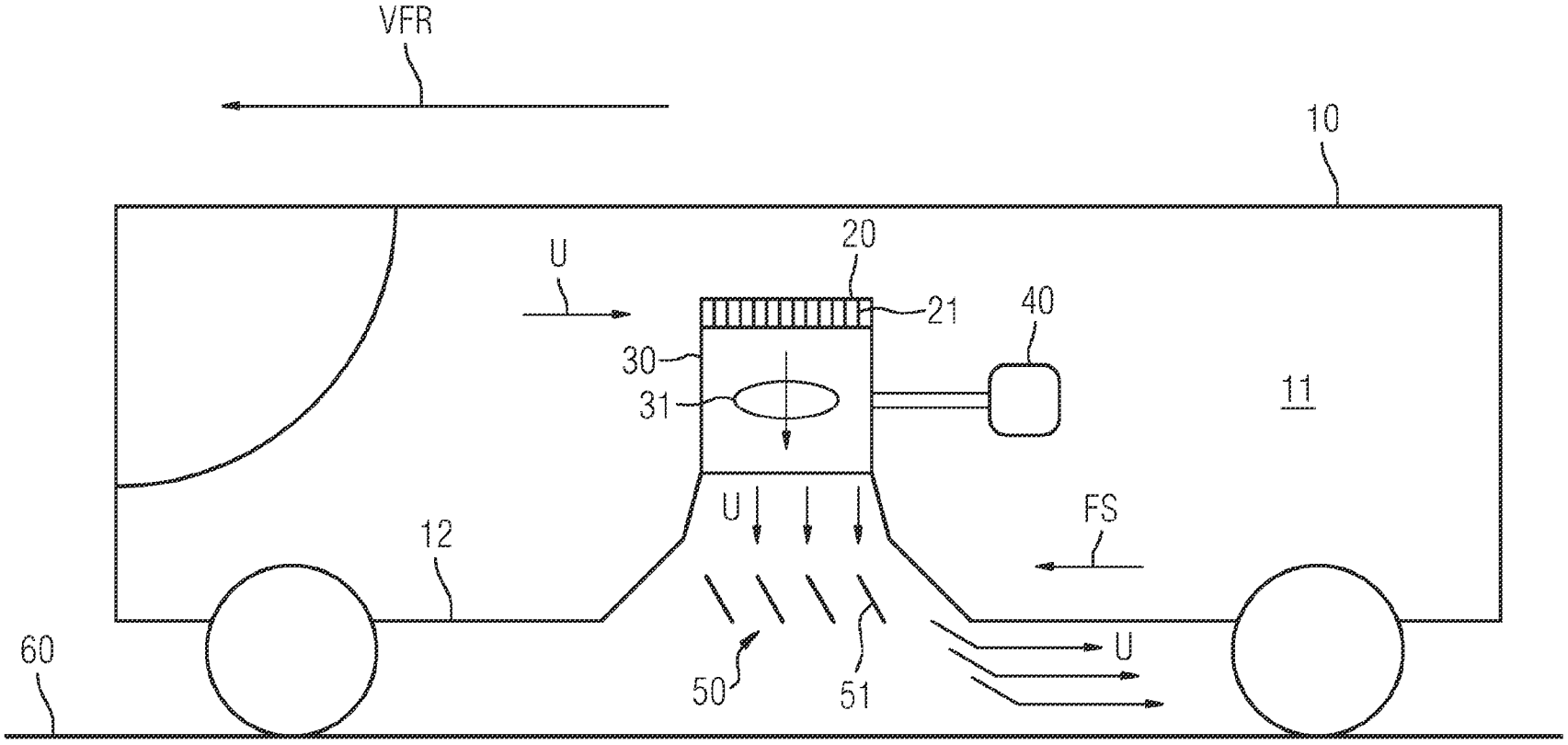
FIG. 1 shows an exemplary embodiment of an inventive vehicle in a side view with forward travel.

For the sake of clarity, in the figures, the same reference characters are always used for identical or similar components.

FIG. 1 shows a schematic side view of an exemplary embodiment of an inventive vehicle 10 with travel in the forward travel direction, which is identified in FIG. 1 with an arrow and the reference character VFR. The vehicle 10 is preferably a rail vehicle.

In the region of a side wall 11, the vehicle 10 has an air inlet opening 20, which is connected to a cooling device 30. The air inlet opening 20 is equipped with guide devices 21 on the air inlet side, which, as a function of the direction of travel, can be adjusted automatically or by means of an adjustment device on the air inlet side which is not shown further in FIG. 1 for the sake of clarity. The guide devices 21 are preferably guide plates.

The cooling device 30 is equipped with a fan 31, which draws ambient air U in through the air inlet opening 20 during operation. The cooling device 30 is used to cool one or more vehicle components, of which by way of example one is shown in FIG. 1 and identified with reference character 40.

On the output side, the cooling device 30 is connected to an air outlet opening 50, which outputs the ambient air U drawn in by the fan 31 by way of the air inlet opening 20 back into the vehicle environment. The air outlet opening 50 is equipped with guide devices 51 on the air outlet side, which, as a function of the direction of travel, can be adjusted automatically or by means of an adjustment device on the air outlet side which is not shown further in FIG. 1 for the sake of clarity. The guide devices 51 are preferably guide plates.

FIG. 1 shows the position of the guide devices 51 during forward travel. It can be seen that the guide devices 51 blow out the ambient air U blown out by the fan 31 against the respective direction of travel, in FIG. 1 therefore against the direction of forward travel VFR, so that the blown-out ambient air U generates a pulse or a thrust force FS which drives the vehicle 10.

The position of the guide devices 51 shown in FIG. 1 is not only advantageous with a view to a driving thrust force FS, but it also prevents the blown-out ambient air U from striking the track-side floor, which is traveled by the vehicle 10, at right angles or at least frontally. If the vehicle 10 is a rail vehicle, for instance, and the track-side floor a track bed 60, air blown out by the fan 31 can namely result in turbulences and ballast pick-up in the track bed 60, if the air were to strike the track bed 60 frontally or at the front; this is advantageously avoided by the deflection or the guide devices 51.

Figure 2:
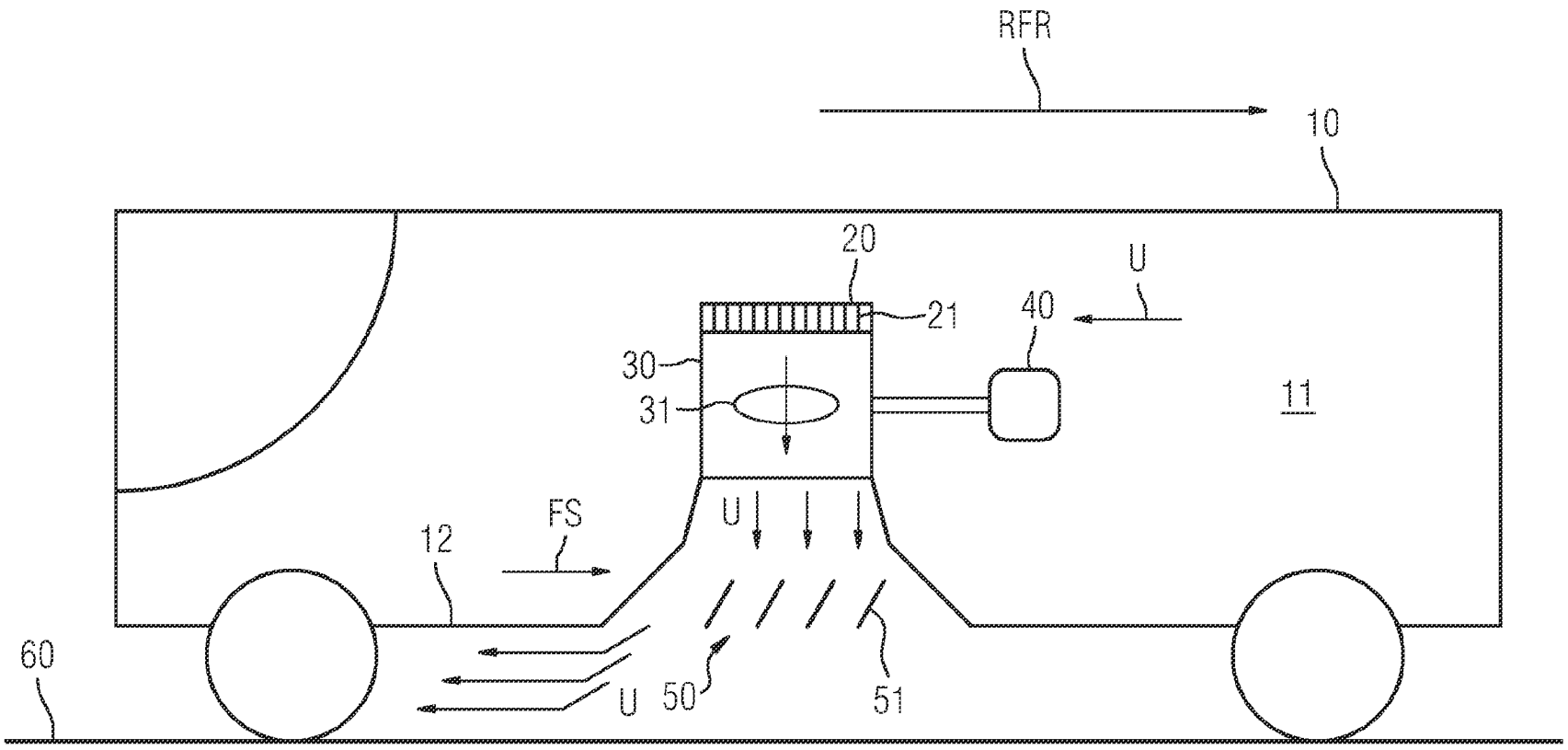
FIG. 2 shows the vehicle according to FIG. 1 in a side view with reverse travel.

FIG. 2 shows the vehicle 10 according to FIG. 1 during reverse travel, in other words along the direction of reverse travel identified with the arrow and the reference character RFR. It can be seen that with reverse travel, the guide devices 51 in the region of the air outlet opening 50 have been relocated, for instance pivoted, automatically or by an adjustment device, not shown further, and now the ambient air blown out by the fan 31 is blown out against the direction of reverse travel RFR or along the direction of forward travel VFR, as a result of which, similarly to the direction of forward travel VFR according to FIG. 1, a thrust force FS is generated in the respective direction of travel.

Also in the position of the guide devices 51 according to FIG. 2, it is advantageously avoided that the ambient air U blown out on the output side by the fan 31 strikes the track bed 60 frontally and can result in ballast pick-up.

Figure 3:
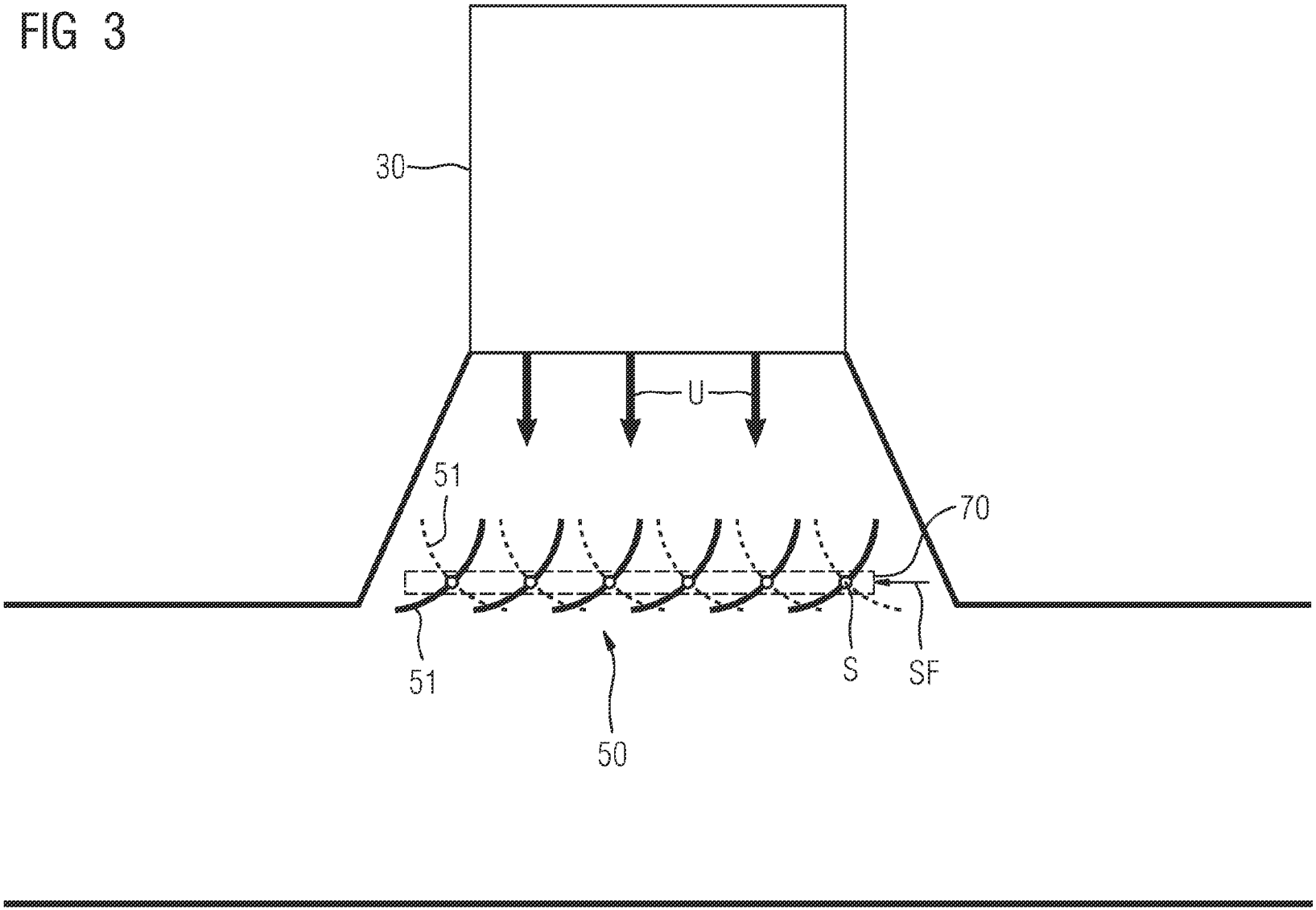

FIG. 3 shows in more detail an exemplary embodiment of an advantageous configuration of the guide devices 51, which can be used in the region of the air outlet opening 50 with the vehicle 10 according to FIGS. 1 and 2. It can be seen that the guide devices 51 are in each case arched and have an outer or convex surface and an inner or concave surface.

The guide devices 50 can be pivoted about a pivot axis S in each case, be it automatically or by means of an indicated adjustment device 70. The adjustment device 70 is preferably adjusted by a direction of travel signal SF, which indicates the respective direction of travel and can be provided for instance by a direction of travel sensor or a vehicle control device.

In FIG. 3, the dashed lines show the position of the guide devices 51 in the event of the travel, shown in FIG. 1, along the direction of forward travel VFR and a continuous line shows the position of the guide devices 51 with reverse travel along the direction of reverse travel RFR according to FIG. 2.

FIG. 4 again shows in another representation the guide devices 51 with travel along the direction of forward travel VFR. It can be seen that the guide devices 51 are aligned so that the convex surfaces 51*a* of the guide devices 51 are facing the headwind W and the concave surfaces 51*b* of the guide devices 51 are facing away from the headwind W. The convex surfaces 51*a* therefore form the windward surfaces and the concave surfaces 51*b* the leeward surfaces.

Figure 4:
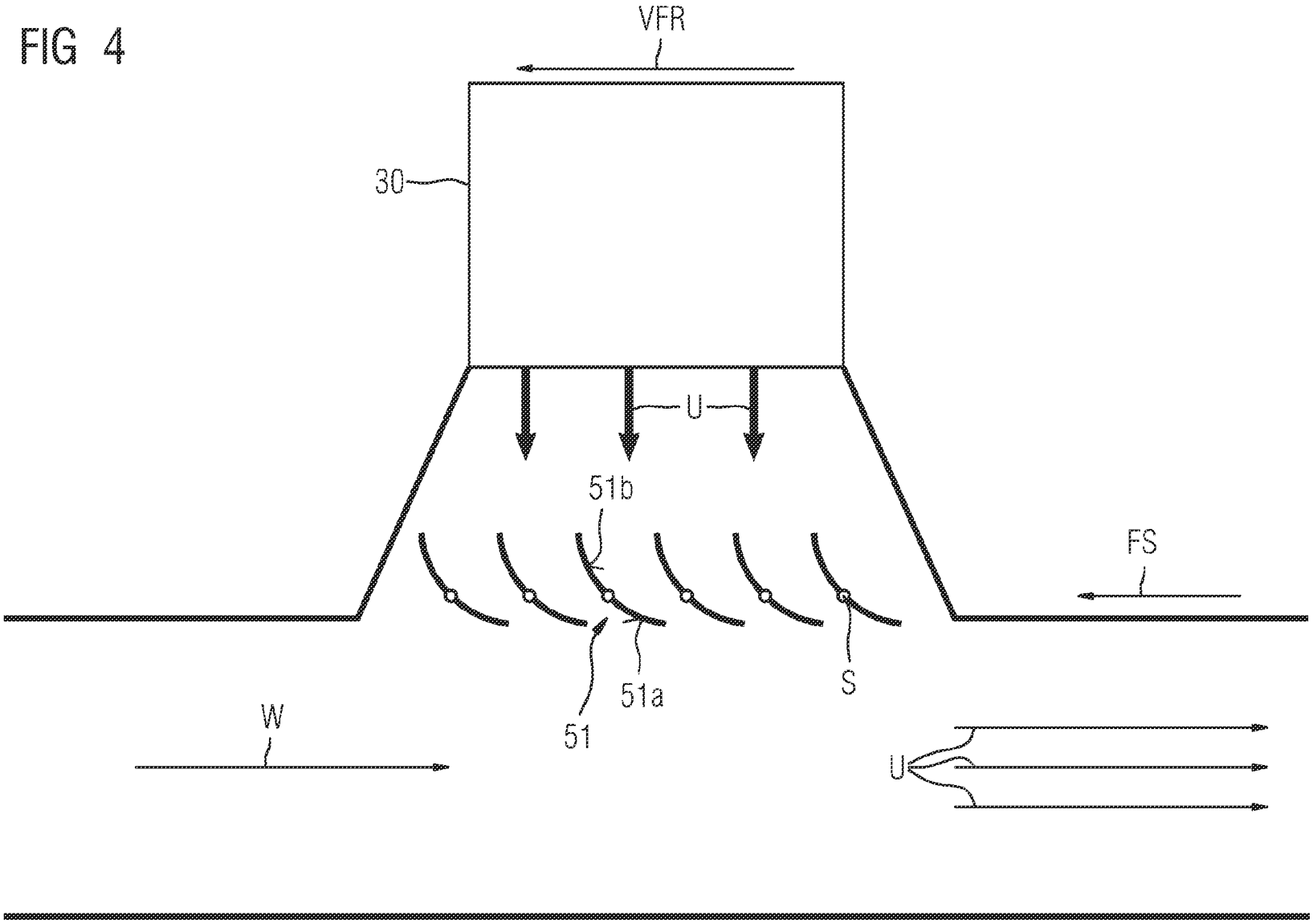
FIG. 4 shows in more detail the guide devices according to FIG. 3 with forward travel.

Moreover, FIG. 4 shows the deflection of the ambient air U expelled by the cooling device 30 by means of the concave, leeward surface 51*b* of the guide devices 51 so that the ambient air U is guided in the direction or along the direction of the headwind W and parallel to the vehicle floor 12.

Figure 5:
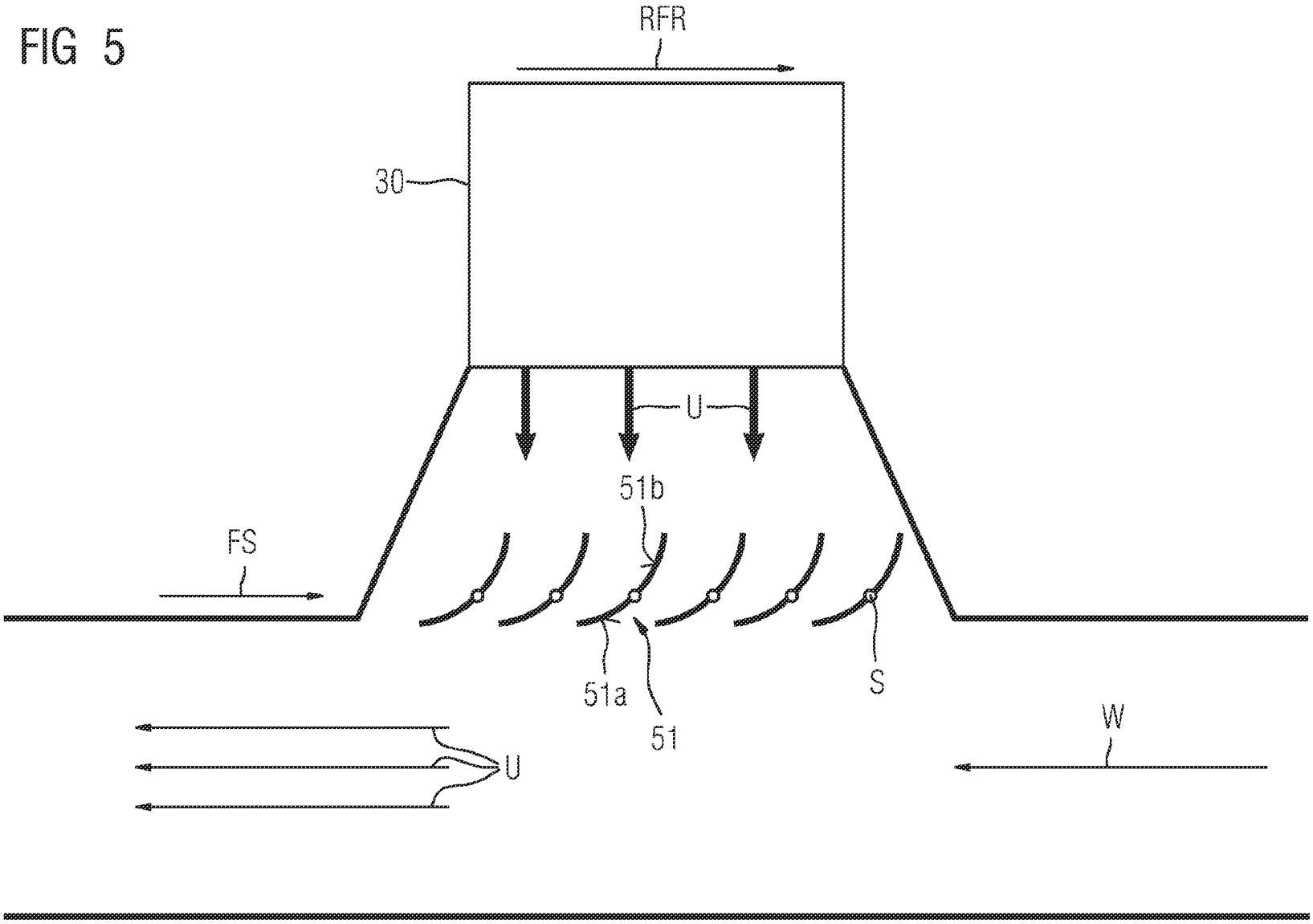
FIG. 5 shows in more detail the guide devices according to FIG. 3 with reverse travel.

FIG. 5 shows the alignment of the guide devices 51 with a reverse travel along the direction of reverse travel RFR according to FIG. 2. It can be seen that the guide devices 51 have now been pivoted about the pivot axis S and the convex surfaces 51*a* of the guide devices are therefore also facing the headwind W. The concave surfaces 51*b* of the guide devices 51 are therefore again on the leeward side.

By adjusting or pivoting the guide devices 51, it is possible for the convex surfaces 51*a* always to be windward and the concave surfaces 51*b* to be leeward.

Moreover, FIG. 5 allows the deflection of the ambient air expelled by the cooling device 30 to be identified along the headwind direction and parallel to the vehicle base 12.

Figure 6:
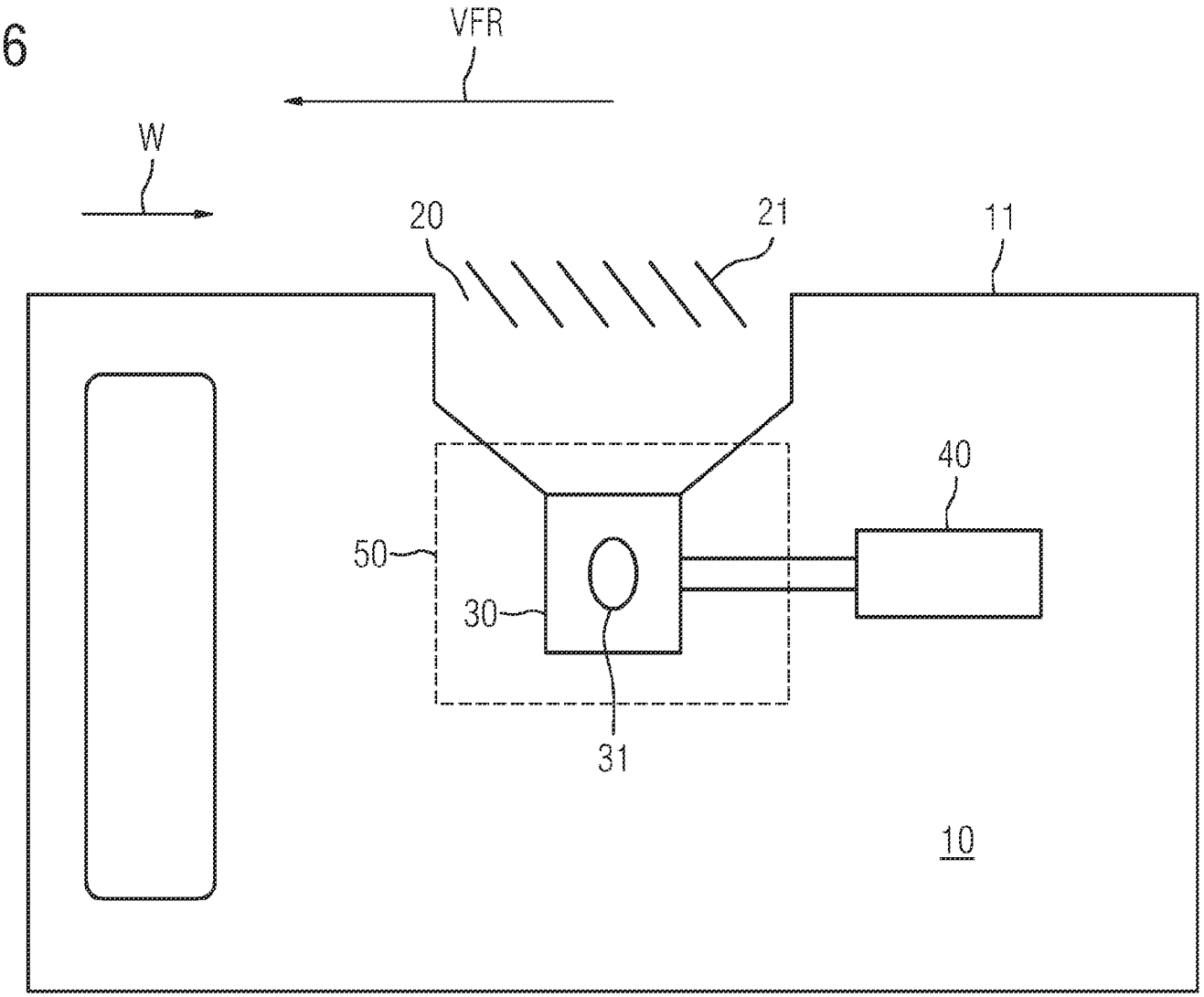
FIG. 6 shows the vehicle according to FIG. 1 in a top view with forward travel.

FIG. 6 show the vehicle 10 according to FIG. 1 with forward travel along the direction of forward travel VFR in a top view. It can be seen that the air inlet opening 20 is arranged in the region of the side wall 11 and has guide devices 21 on the air inlet side which can be adjusted as a function of the direction of travel.

With the direction of forward travel VFR shown in FIG. 6, the guide devices 21 on the air inlet side are aligned so that headwind W is introduced into the air inlet opening 20.

Figure 7:
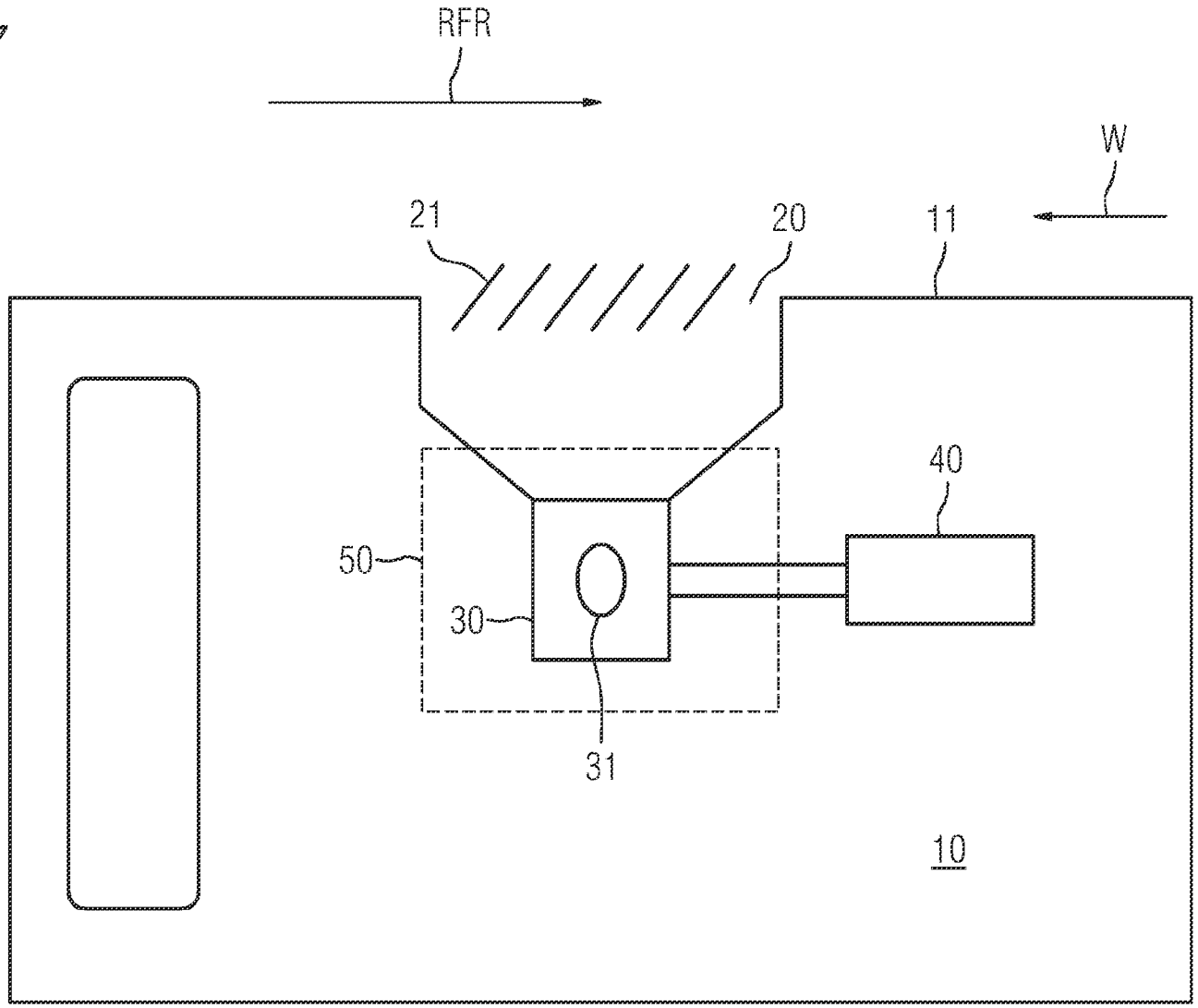
FIG. 7 shows the vehicle according to FIG. 1 in a top view with reverse travel.

FIG. 7 shows, likewise in a top view, the vehicle 10 according to FIGS. 1 and 2 with reverse travel along the direction of reverse travel RFR. It can be seen that the guide devices 21 on the air inlet side have now been adjusted or pivoted and in turn are aligned in the direction of the headwind W so that the headwind W is introduced into the air inlet opening 20.

Also with the guide devices 21, the adjustment process ensures that one surface of the guide devices is always the windward surface (with respect to the headwind W) and the other surface is always the leeward surface.

The guide devices 21 on the air inlet side are preferably arched in each case and in each case have concave windward surfaces and convex leeward surfaces, similarly to the guide devices 51 on the air outlet side, such as have been explained by way of example in conjunction with FIGS. 3, 4 and 5.

Although the invention has been illustrated and described in detail on the basis of preferred exemplary embodiments, the invention is not restricted by the examples given and other variations can be derived therefrom by a person skilled in the art without departing from the protective scope of the invention.

LIST OF REFERENCE CHARACTERS

10 vehicle
11 side wall
12 vehicle floor
20 air inlet opening
21 guide devices
30 cooling device
31 fan
40 vehicle component
50 air outlet opening
51 guide devices
51A convex surface/windward surface
51B concave surface/leeward surface
60 track bed
70 adjustment device
FS pulse/thrust force
RFR direction of reverse travel
S pivot axis
SF direction of travel signal
U ambient air
VFR direction of forward travel
W headwind

The invention claimed is:

1. A vehicle, comprising:

at least one air inlet opening for admitting ambient air;

at least one air outlet opening for discharging the ambient air, said at least one air outlet opening having an outlet side, at least one adjustable guide device being pivoted automatically or by an adjustment device on said air outlet side into a forward travel position upon the vehicle traveling in a direction of forward travel and into a reverse travel position, differing from said forward travel position, upon the vehicle traveling in a direction of reverse travel; and an air-cooled cooling device in communication with said at least one air inlet opening and said at least one air outlet opening for cooling at least one vehicle component, said air-cooled cooling device guiding the ambient air in one direction from said at least one air inlet opening to said at least one air outlet opening during forward and reverse travel of the vehicle.

2. The vehicle according to claim 1, wherein said at least one adjustable guide device is oriented as a function of the direction of travel to cause the ambient air to be blown out through said at least one air outlet opening against or at least predominantly against a respective direction of travel when the vehicle is traveling.

3. The vehicle according to claim 1, wherein said at least one adjustable guide device has a windward surface facing a headwind during forward travel and reverse travel, and said at least one adjustable guide device has a leeward surface facing away from the headwind during forward travel and rearward travel.

4. The vehicle according to claim 1, wherein said at least one adjustable guide device is pivotable:

during forward travel in a forward travel pivoting position, in which ambient air blown out through said at least one air outlet opening is blown out in the direction of reverse travel or at least predominantly in the direction of reverse travel, and during reverse travel in a reverse travel pivoting position, in which ambient air blown out through said at least one air outlet opening is blown out in the direction of forward travel or at least predominantly in the direction of forward travel.

5. The vehicle according to claim 1, wherein said air-cooled cooling device includes a fan drawing-in the ambient air from said at least one air inlet opening and blowing-out the ambient air at said at least one air outlet opening, the ambient air being drawn-in and blown-out at a higher flow speed than a travel speed of the vehicle by generating a thrust force driving the vehicle.

6. The vehicle according to claim 1, wherein:

said at least one air outlet opening is disposed on a vehicle floor spaced apart from a track side floor by a gap; and ambient air blown out through said at least one air outlet opening during vehicle travel is blown out against a respective direction of travel or at least predominantly against a respective direction of travel into the gap between the track side floor and the vehicle floor.

7. The vehicle according to claim 1, wherein said at least one air inlet opening includes an air inlet side and at least one guide device being adjustable as a function of the direction of travel and being aligned automatically or by an adjustment device on said air inlet side as a function of the direction of travel.

8. The vehicle according to claim 7, wherein said at least one adjustable guide device on said air inlet side is pivoted:

during forward travel into a forward travel pivoting position, in which a first surface of said at least one adjustable guide device on said air inlet side is a windward surface and a second surface of said at least one adjustable guide device on said air inlet side is a leeward surface; and during reverse travel in a reverse travel pivoting position, in which said first surface is again the windward surface and said second surface is again the leeward surface.

9. The vehicle according to claim 8, wherein:

said at least one air outlet opening is disposed on a vehicle floor of the rail vehicle being spaced apart from a track bed by a gap; and ambient air blown out through said at least one air outlet opening during vehicle travel is blown out against a respective direction of travel and parallel to the rail vehicle floor or with a phase-angle error of at most 10 degrees from parallel the respective direction of travel into the gap between the track bed and the vehicle floor.

10. The vehicle according to claim 1, wherein the vehicle is a rail vehicle.

* * * * *